US005542269A

United States Patent [19]

Richards

[11] Patent Number: 5,542,269

[45] Date of Patent: Aug. 6, 1996

[54] WARP KNITTED FABRIC WITH RIBBED SATIN-LIKE BACK

[75] Inventor: David T. Richards, Greensboro, N.C.

[73] Assignee: Guilford Mills, Inc., Greensboro, N.C.

[21] Appl. No.: 397,431

[22] Filed: Mar. 1, 1995

[51] Int. Cl.[6] ..... D04B 21/18; D04B 21/14

[52] U.S. Cl. ..... 66/195; 66/192

[58] Field of Search ..... 66/192, 194, 195

[56] References Cited

U.S. PATENT DOCUMENTS 3,027,738 6/1956 Turton ..... 66/195
3,474,644 10/1969 Frank ..... 66/195 X
4,096,609 6/1978 Sayre ..... 66/195 X
4,881,383 11/1989 Spillane et al. ..... 61/194

*Primary Examiner*—John J. Calvert
*Attorney, Agent, or Firm*—Shefte, Pinckney & Sawyer

[57] ABSTRACT

A three-bar warp knitted fabric whose technical back has both a satin-like surface and a walewise ribbed effect is produced on a three-bar warp knitting machine by knitting ground yarns on the machine's middle bar to provide structural and dimensional integrity to the fabric, knitting satin-effect yarns on the machine's top bar in extended underlaps to produce a satin-like technical back of the fabric, and inlaying elastic yarns from the machine's bottom bar in a two-in, one-out alternating pattern to create the appearance of walewise ribs in the satin-like technical back surface.

13 Claims, 1 Drawing Sheet

WARP KNITTED FABRIC WITH RIBBED SATIN-LIKE BACK

BACKGROUND OF THE INVENTION

The present invention relates generally to warp knitted fabrics and methods of producing such fabrics and, more particularly, to a warp knitted fabric whose technical back has both a satin-like surface and a walewise ribbed effect.

Traditionally and technically speaking, satin fabrics are produced by weaving warp and filling yarns in any of a variety of satin-weave patterns wherein the warp yarns extend in elongated floats at one fabric face to predominate its surface. Thus, a satin weave provides a glossier appearance than other types of weaves and, accordingly, yarns of relatively bright luster are commonly utilized in satin weaves to enhance this effect.

It is also possible to produce a satin-effect fabric by warp knitting a set of lustrous warp yarns in a stitch pattern producing extending underlaps of the yarn at the technical back of the fabric. Thus, as will be understood, the extended underlaps of lustrous yarns cause them to predominate the technical back of the fabric thereby producing a surface appearance simulative of satin weave. As desired, another set of warp yarns may be knitted in a jersey, chain, or other plain stitch pattern at the technical face of the fabric as a substrate or ground to provide structural integrity to the fabric.

In the past, variations on the basic construction of a warp knitted satin-effect fabric have been proposed for diverse purposes such as attempting to minimize the tendency of the extended underlaps to pick or snag (U.S. Pat. No. 3,027,738 is representative) and to provide a special effect such as brushability or nappability to the opposite technical face of the fabric (U.S. Pat. No. 4,881,383 is exemplary), but in virtually all cases, the desire has typically been to leave unaltered the basic satin appearance and effect at the technical back of the fabric.

SUMMARY OF THE INVENTION

In contrast to the prior art, it is an object of the present invention to provide a warp knitted satin-effect fabric whose technical back has the unique combination of both a satin-like surface appearance and a walewise ribbed effect.

Briefly summarized, the foregoing objective is accomplished in the present invention by inlaying in the structure of the fabric a set of elastic yarns at walewise spacings from one another to create the appearance of walewise ribs in the satin-effect surface of the technical back. More particularly, the textile fabric of the present invention is basically of a warp knitted construction comprising multiple yarns interknitted with one another in stitches arranged in longitudinally extending fabric wales and transversely extending fabric courses, including a set of yarns warp knitted in coursewise spaced stitches with extended underlaps therebetween at the technical back of the fabric to form a satin-like surface effect and a set of elastic yarns inlaid with the stitches of the satin-effect yarns at the technical face of the fabric. The elastic yarns extend in a coursewise reciprocating inlay pattern, with the elastic yarns preferably being arranged in pairs inlaid side-by-side in adjacent fabric stitches in identical inlay patterns. According to the present invention, each pair of elastic yarns is spaced coursewise from each adjacent pair by an intervening fabric stitch unoccupied by any elastic yarn. In this manner, the absence of elastic yarns in the intervening stitches creates the appearance of walewise ribs in the satin-effect surface of the technical back extending along the coursewise spacings between the elastic yarns.

In the preferred embodiment, the reciprocating inlay pattern of the elastic yarns preferably extends across at least two fabric wales. For example, the elastic yarns may be warp knitted in a 0-0,2-2 stitch pattern. The satin-effect yarns may be knitted in substantially any traditional satin-effect stitch pattern wherein the stitches of each satin-effect yarn are spaced from one another by at least one intervening wale to form the extended underlaps as desired. By way of example, in the preferred embodiment herein described, the satin-effect yarns are warp knitted in a 2-3,1-0 stitch pattern, but persons skilled in the art will recognize and understand that other extended underlap patterns may also be used, e.g., 3-4,1-0 or 4-5,1-0 stitch patterns. It is also preferred that a set of ground yarns be warp knitted between the satin effect yarns and the elastic yarns to provide dimensional and structural integrity to the fabric. For example, ground yarns warp knitted in a 1-0,1-2 stitch pattern would be suitable for this effect. To best achieve the desired satin-like effect at the technical back of the fabric, the satin-effect yarns should preferably have a relatively bright surface luster, while the ground and elastic yarns will typically have a relatively dull surface luster.

DESCRIPTION OF THE PREFERRED EMBODIMENT

Figure 1:
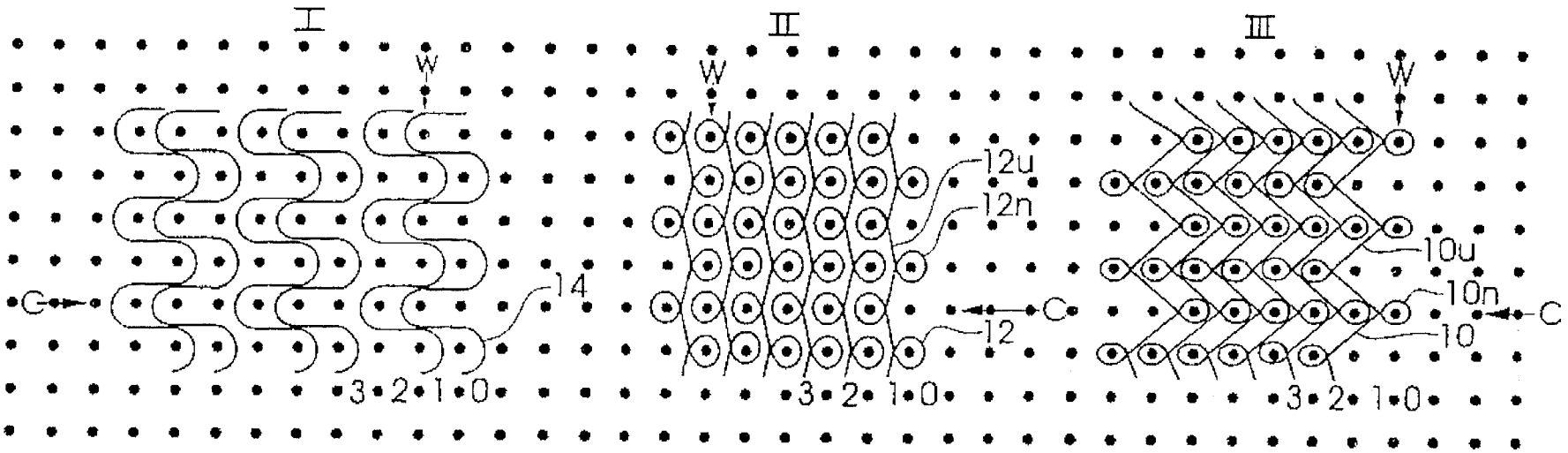
FIG. 1 is a diagram showing individually the stitch patterns for the satin-effect, ground, and elastic yarns carried out by a warp knitting machine in knitting one preferred embodiment of the present fabric according to the method of the present invention.

As explained more fully herein, the fabric of the present invention is formed on a warp knitting machine which may be of any conventional type of an at least three-bar construction having three or more yarn guide bars and a needle bar, e.g., a conventional tricot warp knitting machine. The construction and operation of such machines are well-known in the knitting art and need not herein be specifically described and illustrated. In the following description, the yarn guide bars of the knitting machine are identified as "top", "middle" and "bottom" guide bars for reference purposes only and not by way of limitation. As those persons skilled in the art will understand, such terms equally identify knitting machines whose guide bars may be referred to as "front", "middle" and "back" guide bars, which machines of course are not to be excluded from the scope and substance of the present invention. As further used herein, the "bar construction" of a warp knitting machine refers to the number of yarn guide bars of the machine, while the "bar construction" of a warp knitted fabric refers to the number of different sets of warp yarns included in the fabric, all as is conventional terminology in the art.

As in conventional, the needle bar of the warp knitting machine carries a series of aligned knitting needles, while each guide bar of the machine carries a series of guide eyes, the needle and guide bars of the machine preferably having the same gauge, i.e., the same number of needles and guide eyes per inch. According to the embodiment of the present fabric illustrated in FIG. 1, the top (or front) yarn guide bar of the machine is threaded on every guide eye with a first set of yarns 10 delivered from a warp beam (not shown), the yarns being suitable for achieving a satin-like surface effect in the knitted fabric, as herein described. The middle guide bar is likewise threaded on every guide eye with a second set of yarns 12 delivered from another warp beam (also not shown), suitable for formation of a ground structure for the fabric, while the bottom (or back) guide bar is threaded with a set of elastic yarns 14 from a third warp beam (also not shown) in a so-called two-in, one-out pattern, i.e., every third guide eye being empty while all other guide eyes receive an elastic yarn. As more fully explained hereinafter, the threading arrangement of the three guide bars is set up in conjunction with the stitch pattern of the three sets of yarns to achieve the desired combination of satin and ribbed effects.

Preferably, all of the ground and satin-effect yarns are multifilament synthetic yarns, e.g., polyester, and are of substantially comparable denier and filament makeup, e.g., a 20 denier, 7 filament polyester yarn, while the elastic yarns are substantially larger in denier and, as is typically, are monofilament, e.g., a 105 denier monofilament LYCRA® brand elastic yarn. It is further preferred that the satin-effect yarns have a relative bright surface luster to enhance the eventual satin-like surface appearance of the fabric as herein described, while the ground and elastic yarns may have a relatively dull surface luster. Of course, those persons skilled in the art will recognize that various other types of yarns may also be employed as necessary or desirable according to the fabric weight, feel, and other characteristics sought to be achieved.

Referring now to the accompanying drawing, one particular embodiment of the present warp knitted fabric of a three-bar construction knitted according to the present invention on a three-bar warp knitting machine, is illustrated. In the accompanying drawings, the stitch construction of the satin-effect, ground, and elastic yarns 10,12,14, as carried out by the respective lateral traversing movements of the guide bars of the knitting machine according to one possible embodiment of the present fabric and method, are respectively illustrated individually in a traditional dot or point diagram format, wherein the individual points 15 represent the needles of the needle bar of the knitting machine in the formation of several successive fabrics courses C across several successive fabric wales W. According to this embodiment, the top (front) guide bar of the machine manipulates the satin-effect yarns 10 to traverse laterally back and forth relative to the needles 15 of the needle bar of the machine to stitch the satin-effect yarns 10 in a repeating 2-3,1-0 stitch pattern, as indicated at III of FIG. 1, as the satin-effect yarns 10 are fed progressively from their respective warp beam. Simultaneously, the middle guide bar of the knitting machine manipulates the ground yarns 12 as they are fed from their respective warp beam to traverse relative to the needles 15 to stitch the ground yarns 12 in a repeating 1-0,1-2 stitch pattern, as indicated at II of FIG. 1. At the same time, the bottom (back) guide bar of the machine manipulates the elastic yarns 14 as they are fed from their respective warp beam to traverse relative to the needles 15 to inlay the elastic yarns 14 in a repeating 0-0,2-2 inlay pattern on spaced pairs of the needles (but not the intervening needles) in the same two-in, one-out alternation as the threading of the elastic yarns on the bottom guide bar, as indicated at I of FIG. 1.

As will thus be understood, the ground yarns 12 are interknitted with one another in the described stitch construction with each ground yarn 10 being formed in needle loops $\mathbf{12}_n$ alternating every course C between a pair of adjacent vertical fabric wales W and in connecting underlaps $\mathbf{12}_u$ extending diagonally between the successive needle loops $\mathbf{12}_n$. The satin-effect yarns 10 are interknitted with one another and with the ground yarns 12 with each satin-effect yarn 10 being formed in needle loops $\mathbf{10}_n$ alternating every course between wales W spaced apart by one intervening wale, the needle loops $\mathbf{10}_n$ being interknitted in plated relationship with the needle loops $\mathbf{12}_n$ of the ground yarn 12 in the respective wales, and in elongated underlaps $\mathbf{10}_u$ extending diagonally between the successive needle loops $\mathbf{10}_n$ in a substantially coursewise direction. Each of the elastic yarns 14 is inlaid in a coursewise reciprocating fashion across a respective pair of wales W to be captured within the plated needle loops $\mathbf{10}_n$, $\mathbf{12}_n$ of the satin-effect and ground yarns 10,12, but elastic yarn is absent from every third wale W due to the threading of the elastic yarns and their inlay pattern.

As will thus be understood, the ground yarns 12 form a base or substrate to the fabric essentially between the satin-effect and elastic yarns 10,14, to appear with the elastic yarns 14 essentially only at the technical face of the fabric. The satin-effect yarns 10 appear outwardly of the ground and elastic yarns 12,14 at the technical back of the fabric with the extended underlaps $\mathbf{10}_u$ of the satin-effect yarns 10 substantially obscuring the underlaps $\mathbf{12}_u$ of the ground yarn 12 and the inlaid elastic yarns 14 at the fabric's technical back to present a satin-like surface. However, the omission of elastic yarns 14 from every third wale W causes the extended coursewise underlaps $\mathbf{10}_u$ of the satin-effect yarns 10 to assume the configuration and appearance of outwardly projecting walewise ribs in the pairs of wales W occupied by the elastic yarns 14, but the satin-effect, i.e., the sheen and luster, achieved by the satin-effect yarns 10 is not impaired because the elastic yarns 14 (as well as the ground yarns 12) reside behind the satin-effect yarns 10 at the technical face of the fabric.

Of course, those persons skilled in the art will readily recognize and understand that many variations of the basic ribbed satin-effect described above may be achieved by varying not only the yarns themselves but also varying their stitch and inlay patterns. For example, other various satin-effect stitch patterns may be utilized for warp knitting the satin-effect yarns 10. For example, the yarns may alternatively be stitched in a 3-4,1-0 or 4-5, 1-0 pattern to achieve more extended satin-effect underlaps $\mathbf{10}_u$ of the satin-effect yarns 10. The threading pattern of the elastic yarns 14 on the bottom guide bar and/or the inlay pattern of the elastic yarns may be altered to achieve greater or lesser frequency in the walewise spacing and/or a greater walewise dimension in the rib effect achieved by the elastic yarns 14. These and other variations of the specific embodiment described herein are considered to be within the conceptual scope and substance of the present invention.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A textile fabric of a warp knitted construction comprising a plurality of yarns interknitted with one another in stitches arranged in longitudinally extending fabric wales and transversely extending fabric courses, characterized by the technical back of said fabric having both a satin-like surface and a walewise ribbed effect, said yarns comprising a set of yarns warp knitted in coursewise spaced stitches with extended underlaps therebetween at the technical back of said fabric forming a satin-like surface effect and a set of elastic yarns inlaid with the stitches of the satin-effect yarns at the technical face of the fabric, said elastic yarns being spaced coursewise from one another to create the appearance of walewise ribs in the satin-effect surface of the technical back along the coursewise spacings between the elastic yarns.

2. A warp knitted textile fabric according to claim 1, wherein the stitches of each said satin-effect yarn are spaced from one another by at least one intervening wale.

3. A warp knitted textile fabric according to claim 2, wherein said satin-effect yarns are warp knitted in a 2-3,1-0 stitch pattern.

4. A warp knitted textile fabric according to claim 1, wherein said elastic yarns extend in a coursewise reciprocating inlay pattern extending across at least two fabric wales.

5. A warp knitted textile fabric according to claim 4, wherein said elastic yarns are warp knitted in a 0-0,2-2 stitch pattern.

6. A warp knitted textile fabric according to claim 4, wherein said elastic yarns are arranged in pairs inlaid side by side in adjacent fabric stitches in identical inlay patterns, each pair of elastic yarns being spaced from each adjacent pair by an intervening fabric stitch unoccupied by any elastic yarn.

7. A warp knitted textile fabric according to claim 1 and further comprising a set of ground yarns warp knitted between said satin-effect yarns and said elastic yarns.

8. A warp knitted textile fabric according to claim 7, wherein said ground yarns are warp knitted in a 1-0,1-2 stitch pattern.

9. A warp knitted textile fabric according to claim 7 wherein said satin-effect yarns have a relatively bright surface lustre and said elastic and ground yarns having a relatively dull surface lustre.

10. A textile fabric of a warp knitted construction comprising a plurality of yarns interknitted with one another in stitches arranged in longitudinally extending fabric wales and transversely extending fabric courses, characterized by the technical back of said fabric having both a satin-like surface and a walewise ribbed effect, said yarns comprising a set of ground yarns warp knitted in a dimensionally stable stitch construction, a set of yarns each warp knitted in stitches spaced coursewise from one another by at least one intervening wale with extended underlaps between said stitches at the technical back of said fabric forming a satin-like surface effect, and a set of elastic yarns inlaid with the stitches of said ground and satin-effect yarns at the technical face of said fabric, said elastic yarns being arranged in pairs inlaid side by side in adjacent fabric stitches in an identical coursewise reciprocating inlay pattern extending across at least two fabric wales and each pair of elastic yarns being spaced coursewise from each adjacent pair by an intervening fabric stitch unoccupied by any elastic yarn to create the appearance of walewise ribs in said satin-effect surface of the technical back along the coursewise spacings between the elastic yarns.

11. A warp knitted textile fabric according to claim 10, wherein said satin-effect yarns are warp knitted in a 2-3,1-0 stitch pattern.

12. A warp knitted textile fabric according to claim 5, wherein said elastic yarns are warp knitted in a 0-0,2-2 stitch pattern.

13. A warp knitted textile fabric according to claim 8, wherein said ground yarns are warp knitted in a 1-0,1-2 stitch pattern.

* * * * *